US007665191B2

(12) United States Patent
Gould

(10) Patent No.: US 7,665,191 B2
(45) Date of Patent: Feb. 23, 2010

(54) INTEGRAL FASTENING SYSTEM

(76) Inventor: Sheldon D. Gould, 4330 Hillcrest Dr., No. 210, Hollywood, FL (US) 33021-7934

( * ) Notice: Subject to any disclaimer, the term of this patent is extended or adjusted under 35 U.S.C. 154(b) by 0 days.

(21) Appl. No.: 12/002,108

(22) Filed: Dec. 14, 2007

(65) Prior Publication Data

US 2009/0151128 A1 Jun. 18, 2009

(51) Int. Cl.
*A44B 21/00* (2006.01)
*A45D 8/00* (2006.01)
*A45D 8/32* (2006.01)

(52) U.S. Cl. ..... 24/351; 24/13; 24/368; 24/561; 24/67 P; 24/67 R; 132/276

(58) Field of Classification Search ..... 24/6, 24/13, 51, 60, 66.13, 67 P, 317, 340, 351, 24/356, 362, 363, 368, 561, 595.1, 706.1, 24/711.1; 132/276
See application file for complete search history.

(56) References Cited

U.S. PATENT DOCUMENTS 616,385 A * 12/1898 Winget ..... 24/67 P
1,071,688 A * 9/1913 Bono ..... 24/351
1,908,229 A * 5/1933 Duer ..... 24/561
2,164,940 A * 7/1939 Polak ..... 132/278
2,795,233 A * 6/1957 Zore ..... 132/276
3,082,773 A * 3/1963 Renstrom et al. ..... 132/278
3,860,014 A * 1/1975 Clifton ..... 132/278
3,950,823 A * 4/1976 Schreter ..... 24/66.13
4,011,639 A * 3/1977 Koleske ..... 24/561
4,241,477 A * 12/1980 Freedom et al. ..... 24/67 R
4,510,654 A * 4/1985 Muller ..... 24/344
5,125,758 A * 6/1992 DeWan ..... 24/67 P
D391,020 S * 2/1998 Tsai ..... D28/40
5,749,382 A * 5/1998 Tsai ..... 132/275
5,775,345 A * 7/1998 Chou ..... 132/278
5,890,498 A * 4/1999 Kawaguchi ..... 132/275
6,000,105 A * 12/1999 Lee et al. ..... 24/368
D428,202 S * 7/2000 Tsai ..... D28/40
D428,670 S * 7/2000 Tsai ..... D28/40
D429,031 S * 8/2000 Tsai ..... D28/40
6,966,103 B2 * 11/2005 Gould ..... 24/351

* cited by examiner

*Primary Examiner*—Robert J Sandy
(74) *Attorney, Agent, or Firm*—Frank L. Kubler

(57) ABSTRACT

A fastening system includes a grommet having a grommet shank and two grommet cap ends secured to opposing ends of the grommet shank; a planar border having a base and integrally formed substantially parallel planar flexible peripheral first and second legs of substantially like length, the first leg having a first leg distal end with a first aperture and the second leg having a second leg distal end with a second aperture and an integral and peripheral first spike having a first spike pointed end, each of the first and second apertures being proportioned for slidable receipt of the grommet when the first and second apertures are aligned with each other; and an elongate securement leg integrally dependant from the base in a direction of the distal ends of the flexible legs, and including a securement leg distal end having a receiving surface for receiving first spike pointed end.

13 Claims, 3 Drawing Sheets

INTEGRAL FASTENING SYSTEM

BACKGROUND OF THE INVENTION

1. Field of the Invention

The present invention relates generally to the field of engaging devices such as hair clips which, subject to adaptations as taught by the within invention, may be employed as a fastening element for the holding of cards and other planar articles. More specifically the present invention relates to an integral spike fastening system. A sheet metal stamped blank shaped to include several distinct regions in the form of a base from which integrally depends first and second substantially planar, flexible, peripheral legs. The first leg includes a first leg proximal end which is integral with the base and a first leg distal end having a preferably rounded periphery and having a first aperture. The second leg includes a second leg proximal end also integral with the base and a second leg distal end with a second aperture and at least a first spike preferably protruding distally from distal end. The first spike is integral with the second leg and formed as part of the stamped blank. The spike is bent at substantially a right angle with respect to the plane of the blank. Additional spikes optionally are provided protruding in various directions from the second leg distal end. Medially disposed between the first and second legs is an elongate securement leg having a securement leg proximal end, which integrally depends from the base, and a securement leg distal end which includes an upwardly bent receiving surface forming an inverted V-shape and preferably having a spike passing slot.

The second leg distal end is placed in alignment with the first leg distal end so that the first and second apertures are in alignment and register. When in this position, a fastener in the form of a rivet or grommet is passed therethrough. When in this position, the receiving surface and slot at securement leg distal end are aligned beneath the point of the spike, so that engagement therebetween can be manually effected the flexible nature of the first and second legs. The resultant structure is one in which a planar article such as a business or identification card may be secured between the spike and the receiving surface when the base is appropriately secured to clothing of a user. The spike optionally is replaced with pointed teeth for gripping clothing. Opposing and parallel rows of teeth preferably are cut out of outward edges of opposing leg tabs on the second leg distal end or along the downwardly protruding edge of a gripping cup stamped out of the second leg distal end.

A second embodiment replaces the securement leg with a panel member such as a badge or a credit card or a hotel room card and a second fastener in the form of a mounting rivet or grommet passes through and interconnects the base and the panel member.

2. Description of the Prior Art

Related prior art includes hair clip patents such as U.S. Pat. No. 2,169,940 (1939) to Polak; U.S. Pat. No. 2,795,233 (1957) to Zore, entitled Clips; U.S. Pat. No. 3,082,773 (1963) to Renstrom, et al, entitled Hair Clip; and U.S. Pat. No. 3,860,014 (1975) to Clifton, entitled Hair Clip.

The patent to Polak discloses a hair clip including a male element which may be secured within a female element to accomplish closure of the clip about a tuft of hair.

Zore teaches a hair clip including a fixed proximal end and a free distal end, and various strategies for the securement of the distal ends of the outermost arms to each other. However, Zore requires the use of a tool to effect a joinder of the ends of the outer arms of the structure to each other.

Renstrom reveals the use of a male element within a center arm of a hair clip in which the male element may be snap within a complemental aperture within a border-like portion of the hair clip.

Clifton teaches the use of a male-female connection in a hair clip.

However, use of a hair clip device for securement of planar articles, such as business or identification cards, cannot be achieved by any of the above structures, or otherwise, taught in the prior art.

In prior U.S. Pat. No. 6,966,103, issued to present applicant Gould on Nov. 22, 2005, a bi-stable hair clip was transformed into a fastening system in which a pin passes through registering apertures in ends of flexible legs to engage an opposing structure to retain a card or engage clothing.

It is thus an object of the present invention to provide a fastening system using the mechanism of a bi-stable hair clip which includes an engaging spike formed from part of the same sheet metal blank forming the remainder of system, replacing the separate engaging pin, which cannot become dislodged and separated.

It is another object of the present invention to provide a fastening system for the securement of planar articles such as identification or hotel room cards, articles of clothing, hairpieces or wigs.

It is finally an object of the present invention to provide such a fastening system which is less expensive to manufacture.

SUMMARY OF THE INVENTION

The present invention accomplishes the above-stated objectives, as well as others, as may be determined by a fair reading and interpretation of the entire specification.

This invention relates to a fastening system for securement of a card, tag or the like to a portion of fabric clothing of a user.

A fastening system is provided, including a grommet having a grommet shank and two grommet cap ends secured to opposing ends of the grommet shank; a planar border having a base and integrally formed substantially parallel planar flexible peripheral first and second legs of substantially like length, the first leg having a first leg distal end with a first aperture and the second leg having a second leg distal end with a second aperture and an integral and peripheral first spike having a first spike pointed end, each of the first and second apertures being proportioned for slidable receipt of the grommet shank, whereby the grommet is inserted through the first and second apertures when they are aligned with each other, and then held by the two a grommet cap ends to enable securement of the planar peripheral legs to each other; and an elongate securement leg integrally dependent from the base in a direction of the distal ends of the flexible legs, and including a securement leg distal end having a receiving surface positioned and configured for receiving first spike pointed end.

The receiving surface preferably includes a slot for passing the first spike pointed end. The receiving surface preferably includes a substantially V-shaped bend toward the first spike. The fastening system preferably additionally includes a second spike having a second spike pointed end extending generally toward the securement leg distal end. The base of the border preferably includes means for securement to a fabric of an article of clothing. The securement arm preferably includes a zone of inducement of flexure. The securement arm preferably includes a zone of inducement of flexure. The system preferably additionally includes clip means having a normally closed selectable open function, the clip means being integrally dependent from the base in a direction opposite the peripheral arms.

A fastening system is further provided including a grommet having a grommet shank and two grommet cap ends secured to opposing ends of the grommet shank; a planar border having a base and integrally formed substantially parallel planar flexible peripheral first and second legs of substantially like length, the first leg having a first leg distal end with a first aperture and the second leg having a second leg distal end with a second aperture and an integral and peripheral including one of: an integral and peripheral leg tab having a tab free end directed generally toward the securement leg distal end and having several engaging teeth in the tab free end, and a cup opening generally toward the securement leg distal end and having several engaging teeth in the cup free end, each of the first and second apertures being proportioned for slidable receipt of the grommet shank, whereby the grommet is inserted through the first and second apertures when they are aligned with each other, and then held by the two a grommet cap ends to enable securement of the planar peripheral legs to each other; and an elongate securement leg integrally dependant from the base in a direction of the distal ends of the flexible legs, and including a securement leg distal end having a receiving surface positioned to meet the teeth.

A fastening system preferably includes a grommet having a grommet shank and two grommet cap ends secured to opposing ends of the grommet shank; a planar border having a base and integrally formed substantially parallel planar flexible peripheral first and second legs of substantially like length, the first leg having a first leg distal end with a first aperture and the second leg having a second leg distal end with a second aperture and an integral and peripheral including one of: an integral and peripheral leg tab having a tab free end directed generally toward the securement leg distal end and having several engaging teeth in the tab free end, and a cup opening generally toward the securement leg distal end and having several engaging teeth in the cup free end, each of the first and second apertures being proportioned for slidable receipt of the grommet shank, whereby the grommet is inserted through the first and second apertures when they are aligned with each other, and then held by the two a grommet cap ends to enable securement of the planar peripheral legs to each other; and a panel member positioned to meet the teeth and a second fastener in the form of a mounting rivet or grommet passing through and interconnecting the base and the panel member.

A fastening system is yet further provided, including a grommet; a planar border having a base and integrally formed substantially parallel planar flexible peripheral first and second legs of substantially like length, the first leg having a first leg distal end with a first aperture and the second leg having a second leg distal end with a second aperture and an integral and peripheral first spike having a first spike pointed end, each of the first and second apertures being proportioned for slidable receipt of the grommet when the first and second apertures are aligned with each other to enable securement of the planar peripheral legs to each other; and an elongate securement leg integrally dependant from the base in a direction opposite of the direction of the distal ends of the flexible legs, and including a securement leg distal end having a receiving surface positioned and configured for receiving the first spike pointed end; so that the first and second leg distal ends can be brought together and the proximal end of the securement leg is bent adjacent to the base so that the securement leg arches underneath the first and second legs and the receiving surface opening is positioned to register with the first spike.

The receiving surface preferably includes a slot for passing the first spike pointed end. The first leg distal end preferably includes at least a first spike and a second spike and wherein the slot in the receiving surface is an arched slot for receiving the first spike and the second spike.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
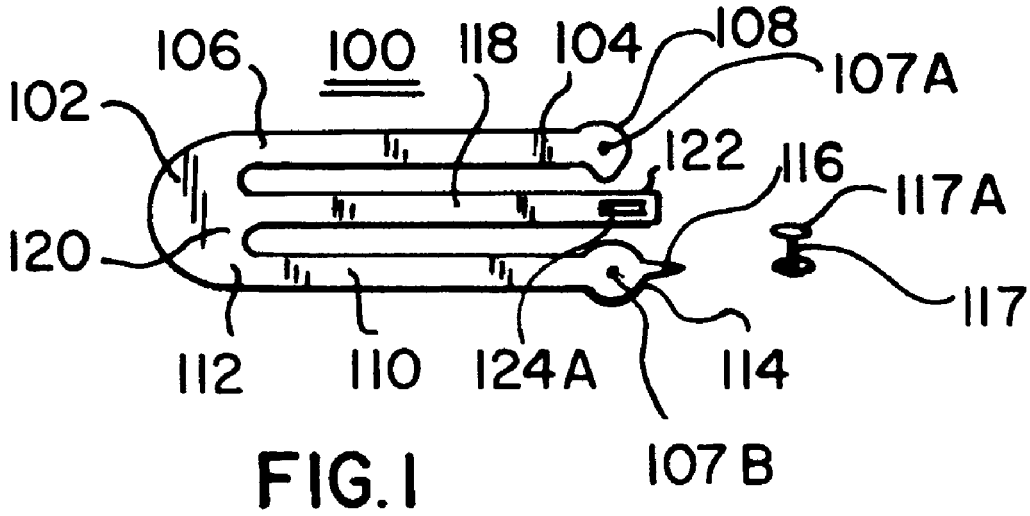
FIG. 1 is a top plan view of a blank for forming the first embodiment of the present invention having the first spike.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1-4, a first embodiment of the integral spike fastening system 100 is disclosed. With reference to the plan view of FIG. 1, a sheet metal stamped blank B to be shaped into system 100 may be seen to include several distinct regions, namely, a base 102 from which integrally depends first and second substantially planar, flexible, peripheral legs 104 and 110, extending forward from base 102. First leg 104 includes a first leg proximal end 106 which is integral with the base 102 and a first leg distal end 108 having a preferably rounded periphery and having a first aperture 107A therein. The second leg 110 includes a second leg proximal end 112 also integral with the base 102 and a second leg distal end 114 with a second aperture 107B therein and at least a first spike 116 preferably protruding distally from distal end 114. First spike 116 is integral with the second leg 110 and formed as part of the stamped blank B. The spike 116 is bent downwardly at substantially a right angle with respect to the plane of the blank B after the blank B is cut. Additional spikes optionally are provided protruding in various directions from leg distal end 114.

Medially disposed between legs 104 and 110 is an elongate securement leg 120 having a securement leg proximal end 121, which integrally depends from the base 102, and a securement leg distal end 122 which includes an upwardly bent receiving surface 124 forming an inverted V-shape and preferably having a spike passing slot 124A.

Figure 2:
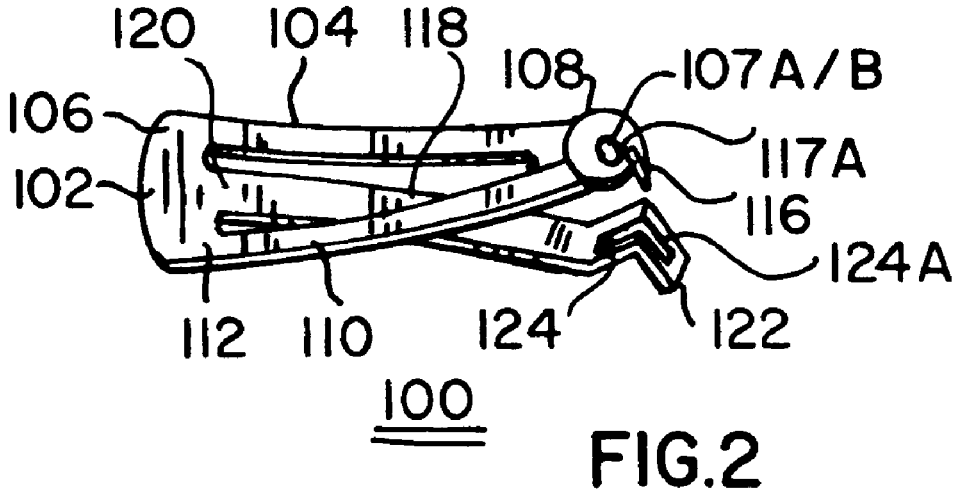
FIG. 2 is a side perspective view of the fastening system assembled from the blank of FIG. 1.

FIG. 2 is an operational view of the first embodiment of fastening system 100 in which the second leg distal end 114 is shown in alignment with the first leg distal end 108, so that apertures 107A and 107B are in alignment and register. When in this position, a fastener in the form of a rivet or grommet 117 having two opposing grommet heads 117A and a grommet shank 117B passing therethrough such that a grommet head 117A is visible in FIG. 2. When in this position, receiving surface 124 and slot 124A at securement leg distal end 122 are aligned beneath the point of spike 116, such that engagement therebetween can be manually effected in the manner shown in FIG. 2. Also shown in FIG. 2 is the flexible nature of legs 104 and 110 of the fastening system 100. The resultant structure of FIG. 2 is one in which a planar article such as a business or identification card may be secured between spike 116 and receiving surface 124 when base 124 is appropriately secured to clothing of a user of fastening system 100. A variation of second leg distal end 114 is shown in FIG. 2A.

Figure 3:
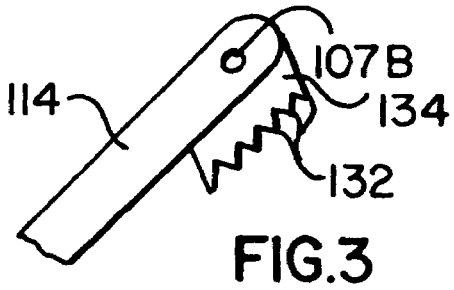
FIG. 3 is a broken away perspective view of second leg distal end having an alternative engaging structure in the form of the gripping arched flange.
Figure 4:
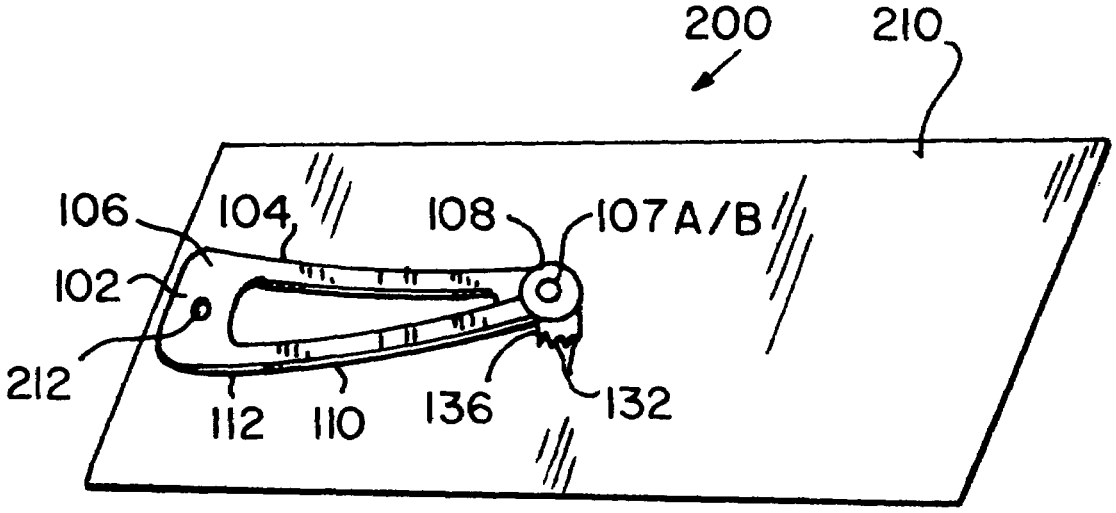
FIG. 4 is a perspective view of the second embodiment of the fastening system having the panel member such as a credit card, badge or hotel door key card in place of the securement leg.

Another variation is shown in FIG. 3 where spike 116 is replaced with pointed teeth 132 for gripping clothing. A row of teeth 132 are provided along the downwardly protruding edge of a gripping arched flange 134 on the second leg distal end of blank B. Preferably five or six teeth 132 are provided, although other numbers are contemplated.

Second Preferred Embodiment

A second embodiment of the fastening system 200 additionally includes a panel member 210 such as a badge or a credit card or a hotel room card and is like the first embodiment except that the securement leg 120 is omitted and a second fastener in the form of a mounting rivet or grommet 212 passes through and interconnects the base 102 and the panel member 210. See FIG. 4.

Third Preferred Embodiment

Figure 5:
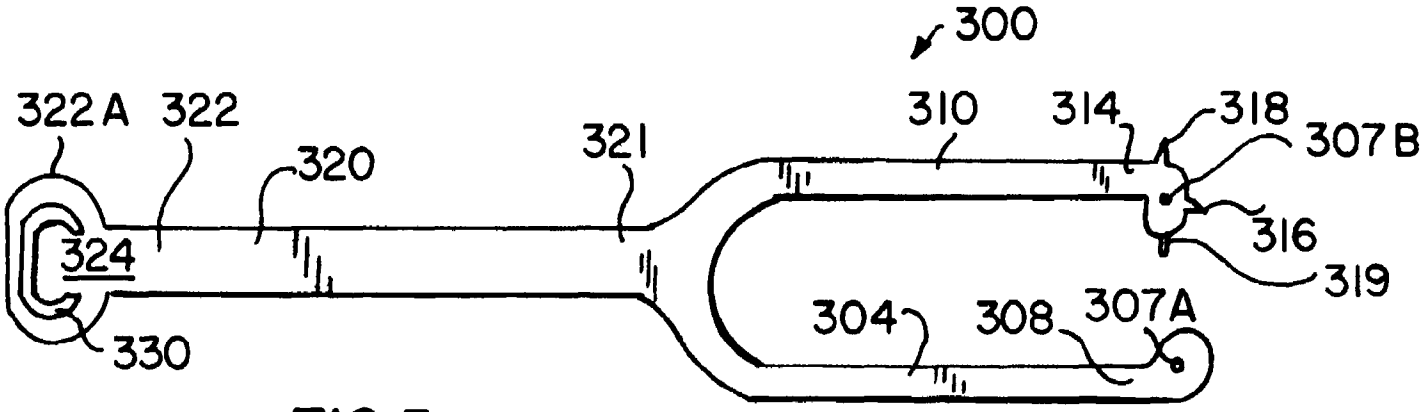
FIG. 5 is a top plan view of a blank for forming the third embodiment of the present invention having three spikes and having a rearwardly extending securement leg with the arched slot.
Figure 6:
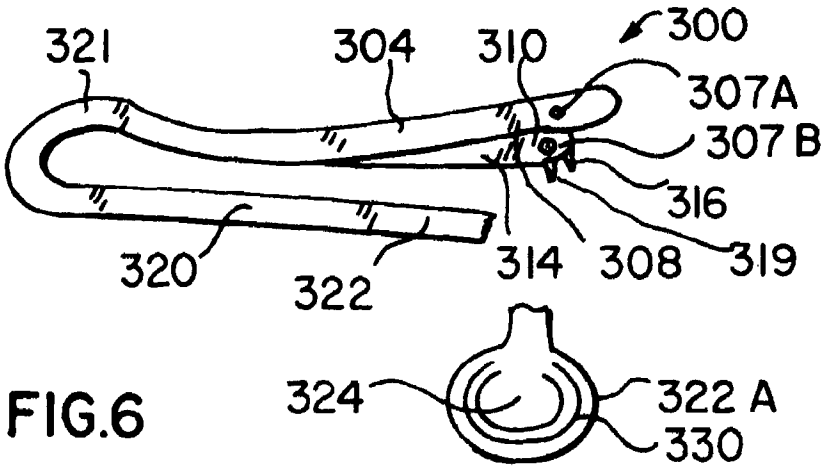
FIG. 6 is a side perspective view of the fastening system assembled from the blank of FIG. 5, with the receiving structure at the distal end of the securement leg broken away.

A third embodiment of the fastening system 300 is similar to the first embodiment except that the securement leg 320 on the third embodiment blank B extends rearwardly from the base 302 so that the blank B substantially defines a fork shape. The distal end 322 of the securement leg 320 has a spike receiving structure 324 including a leg distal end expanded portion 322A with a C-shaped or arched slot 330 for receiving multiple spikes, such as spikes 316, 318 and 319 as shown in FIG. 5. The blank B is reconfigured to form the operational spike fastening system 300, by aligning the second leg distal end 314 with the first leg distal end 308, so that apertures 307A and 307B are in alignment and register, as for the first embodiment, and a fastener in the form of a rivet or grommet 117 is passed therethrough. The proximal end 321 of securement leg 320 is bent adjacent to the base 302 so that the arches underneath the first and second legs 304 and 310 respectively and the arched slot 330 is positioned to register with and receive first, second and third spikes 316, 318 and 319. See FIG. 6.

It is to be appreciated that certain of the structures taught in U.S. Pat. No. 2,795,233 to Zore may be incorporated into the embodiments set above set forth.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A fastening system, comprising:

a grommet;

a planar border having a base and integrally formed substantially parallel planar flexible peripheral first and second legs of substantially like length, said first leg having a first leg distal end with a first aperture and said second leg having a second leg distal end with a second aperture and an integral and peripheral first spike having a first spike pointed end, each of said first and second apertures being proportioned for slidable receipt of said grommet when said first and second apertures are aligned with each other to enable securement of said planar peripheral legs to each other;

and elongate securement leg integrally dependant from said base in a direction of said distal ends of said flexible legs, and including a securement leg distal end having a receiving surface positioned and configured for receiving said first spike pointed end.

2. The fastening system of claim 1, wherein said receiving surface comprises a slot for passing said first spike pointed end.

3. The fastening system of claim 1, wherein said receiving surface comprises a substantially V-shaped bend toward said first spike.

4. The fastening system of claim 1, additionally comprising a second spike having a second spike pointed end extending generally toward said securement leg distal end.

5. The fastening system as recited in claim 1, in which said base of said border comprises: means for securement to a fabric of an article of clothing.

6. The system as recited in claim 5, in which said securement arm includes a zone of inducement of flexure.

7. The system as recited in claim 5, in which said securement arm includes a zone of inducement of flexure.

8. The system as recited in claim 1, in which said base further comprises:

clip means having a normally closed selectable open function, said means integrally dependent from said base in a direction opposite said peripheral arms.

9. A fastening system, comprising:

a grommet having a grommet shank and two grommet cap ends secured to opposing ends of said grommet shank;

a planar border having a base and integrally formed substantially parallel planar flexible peripheral first and second legs of substantially like length and having first and second leg distal ends, an elongate securement leg integrally dependant from said base in a direction of said distal ends of said flexible peripheral first and second legs, said securement leg having a securement leg distal end, wherein said first leg has a first leg distal end with a first aperture and said second leg having a second leg distal end with a second aperture and an integral and peripheral gripping arched flange having a plurality of engaging teeth directed generally toward said securement leg distal end, each of said first and second apertures being proportioned for slidable receipt of said grommet when said first and second apertures are aligned with each other to enable securement of said planar peripheral legs to each other;

wherein said securement lea distal end has a receiving surface positioned to meet said teeth.

10. A fastening system, comprising:

a grommet having a grommet shank and two grommet cap ends secured to opposing ends of said grommet shank;

a planar border having a base and integrally formed substantially parallel planar flexible peripheral first and second legs of substantially like length, said first leg having a first leg distal end with a first aperture and said second leg having a second leg distal end with a second aperture and an integral and peripheral first spike having a first spike pointed end, each of said first and second apertures being proportioned for slidable receipt of said grommet when said first and second apertures are aligned with each other to enable securement of said planar peripheral legs to each other;

and a panel member positioned to meet said teeth and a second fastener in the form of a mounting rivet or grommet passing through and interconnecting said base and said panel member.

11. A fastening system, comprising:

a grommet;

a planar border having a base and integrally formed substantially parallel planar flexible peripheral first and second legs of substantially like length, said first leg having a first leg distal end with a first aperture and said second leg having a second leg distal end with a second aperture and an integral and peripheral first spike having a first spike pointed end, each of said first and second apertures being proportioned for slidable receipt of said grommet when said first and second apertures are aligned with each other to enable securement of said planar peripheral legs to each other;

and an elongate securement leg integrally dependant from said base in a direction opposite of the direction of said distal ends of said flexible legs, and including a securement leg distal end having a receiving surface positioned and configured for receiving said first spike pointed end;

such that said first and second leg distal ends can be brought together and said proximal end of said securement leg is bent adjacent to said base such that said securement leg arches underneath said first and second legs and said receiving surface opening is positioned to register with said first spike.

12. The fastening system of claim 11, wherein said receiving surface comprises a slot for passing said first spike pointed end.

13. The fastening system of claim 12, wherein said first leg distal end comprises at least a first spike and a second spike and wherein said slot in said receiving surface is an arched slot for receiving said first spike and said second spike.

* * * * *